US006109014A

United States Patent [19]

Koltze et al.

[11] Patent Number: 6,109,014

[45] Date of Patent: Aug. 29, 2000

[54] METHOD AND DEVICE FOR INITIATING THE REWINDING PROCESS AFTER A YARN BREAK DURING POT SPINNING

[75] Inventors: Karl Koltze, Mönchengladbach; Peter Voidel; Bernhard Schwabe, both of Chemnitz, all of Germany

[73] Assignee: W. Schlafhorst AG & Co., Moenchengladbach, Germany

[21] Appl. No.: 09/235,895

[22] Filed: Jan. 22, 1999

[30] Foreign Application Priority Data

Jan. 24, 1998 [DE] Germany ..... 198 02 656
Oct. 26, 1998 [DE] Germany ..... 198 49 191

[51] Int. Cl.[7] ..... D01H 1/08

[52] U.S. Cl. ..... 57/76; 57/77; 57/261; 57/264; 57/267; 57/279; 57/312; 57/313

[58] Field of Search ..... 57/76, 77, 261, 57/264, 267, 279, 312, 313

[56] References Cited

FOREIGN PATENT DOCUMENTS 842 916 7/1949 Germany .
PS 833 903 7/1949 Germany .
44 00 999 A1 7/1995 Germany .
195 20 153 A1 12/1996 Germany .
195 23 937 A1 1/1997 Germany .
195 23 938 A1 1/1997 Germany .
348 346 9/1960 Switzerland .

*Primary Examiner*—John J. Calvert
*Assistant Examiner*—Mary K. Fiore
*Attorney, Agent, or Firm*—Kennedy Covington Lobdell & Hickman LLP

[57] ABSTRACT

A method and a device for initiating the rewinding process after a yarn break in single stage pot spinning. In the process, a yarn detaching device (14) is introduced into a spinning centrifuge (3) rotating a high rpm, and places a cutting edge (16, 48) against the conically wound portion (32) of a spinning cake (15) deposited on the inner wall (26) of the spinning centrifuge (3). The yarn detaching device (14) has a yarn guide device, whose yarn guide contour (17, 43) covers the cutting edge (16, 48) of the yarn detaching device (14) such that in the course of the initiation of the rewinding process lower winding layers of the conically wound portion (32) are lifted on the rewinding tube (9) and in this way dependably prevents the winding of yarn around the yarn detaching device (14) during the rewinding process.

21 Claims, 5 Drawing Sheets

METHOD AND DEVICE FOR INITIATING THE REWINDING PROCESS AFTER A YARN BREAK DURING POT SPINNING

FIELD OF THE INVENTION

The present invention relates to a method and a device for initiating the rewinding process after a yarn break during single stage pot spinning by introducing a detaching device into the rotating spinning centrifuge and applying the detaching device to the spinning cake deposited on the interior wall of the centrifuge.

BACKGROUND OF THE INVENTION

In pot spinning, in particular with so-called single stage pot spinning, the rewinding process of the spinning cake deposited on the inner centrifuge wall of the pot spinning unit is customarily initiated by means of a rewinding tube, i.e. an empty tube, which is kept in readiness during the regular spinning process on the yarn guide tube and is lowered over the mouth of the yarn guide tube for initiating the rewinding process. In the process, the edge of the empty rewinding tube grasps the rotating yarn leg exiting from the yarn guide tube, with the result that the spinning cake deposited on the inner wall of the centrifuge then rewinds onto the empty tube.

However, difficulties arise if a yarn break occurs during the spinning process, i.e. during the build-up of the spinning cake. Although with single stage pot spinning it is possible to continue spinning after a yarn break, during subsequent rewinding the amount of yarn spun up to the time of the yarn break remains in the spinning centrifuge and as a rule can only be removed by stopping the centrifuge.

Various methods and devices have already been developed in the past which were intended to make it possible to still rewind the spinning cake deposited in the centrifuge after a yarn break and in this way to save the yarn for further processing. However, most of the known methods and devices have various disadvantages and therefore were not accepted in actual use.

For example, a method is known from German Patent Publication DE 44 00 999 A1, which had been developed in connection with the so-called dual-stage pot spinning. In case of a yarn break, a firm catch yarn is introduced into the rotating spinning centrifuge through the yarn guide tube with this method. The catch yarn becomes twisted together with the inner winding of the spinning cake, so that the rewinding process, i.e. the second stage of the known pot spinning method, can be initiated thereafter by pulling the catch yarn back. However, the use of a firm catch yarn is disadvantageous in this method, since the foreign yarn must afterwards be carefully removed. Furthermore, the functional dependability of this method is relatively low.

A special tube is described in German Patent Publication DE 195 23 937 A1, which has a radially projecting plate-like widening at one of its longitudinal ends. After a yarn break, the broken yarn end as a rule lies against the inner surface of the spinning cake in the form of a chord-like extent of the yarn. The plate-like widening of the specially designed tube is intended to grasp this chord-like yarn end portion and to use the latter for initiating the rewinding process. However, in actual use this special rewinding tube was not convincing in connection with all yarn types. The chord-like yarn end portion sometimes is not clearly defined so that grasping this yarn portion was shown to be extremely difficult with some yarn types.

Devices for initiating the rewinding process after a yarn break in connection with pot spinning devices are also known from Swiss Patent 348 346 and German Patent 842 916. The Swiss patent describes by way of example a broom-like tool which is manually introduced into the rotating spinning centrifuge after a yarn break and has thin wire feelers for placement against the inner layer of the spinning cake to initiate the rewinding process. Because of the high rpm of modem spinning centrifuges, the manual insertion of such a tool into the spinning centrifuge represents a considerable risk of accidents and is therefore no longer permitted for use in present-day spinning machines, if for no other reason than protection against accidents.

German Patent 842 916 describes a device having an arm which can be introduced into the spinning centrifuge and placed against the inner yarn windings of the spinning cake. However, with this device it is disadvantageous that the detaching tool, i.e. the arm placed against the spinning cake, is also wound during the rewinding process. As a rule, the spinning cop created in the process can no longer be unwound and therefore constitutes waste.

SUMMARY OF THE INVENTION

In view of the above mentioned prior art, it is an object of the present invention to develop a method and a device which improve the known rewinding processes of pot spinning, in particular following a yarn break.

This object is attained by means of a method and device for pot spinning of the basic type wherein a yarn is deposited on the interior wall of a rotating spinning centrifuge in the form of a spinning cake having a conically wound portion at at least one end of the spinning cake. In accordance with the invention, the method and device initiates rewinding of the spinning cake onto a rewinding tube after a yarn break by introducing a yarn detaching device into the spinning centrifuge and applying the yarn detaching device to the spinning cake deposited on the interior wall of the centrifuge. More specifically, the yarn detaching device is applied to the spinning cake by placing the yarn detaching device via a drive against the conical winding portion of the spinning cake and lifting winding layers of the spinning cake to the level of the rewinding tube via a yarn guide contour arranged on the yarn detaching device without winding of yarn around the yarn detaching device during the rewinding process.

The method in accordance with the invention has a significant advantage that it is possible without problems to initiate a rewinding process even after a yarn break, wherein neither the yarn deposited on the centrifuge wall as a spinning cake nor the yarn detaching device are damaged.

That is, following the initiation of the rewinding process by the detaching device, the yarn is immediately guided upward in the axial direction by the yarn guide contour of the yarn detaching device, and is wound in a controlled manner on the rewinding tube. In this manner, the winding of yarn around the yarn detaching device is dependably prevented.

It is preferably provided that the yarn detaching device is introduced into the spinning centrifuge parallel to the inner wall thereof, and is placed against the spinning cake in the lower area of the conically wound portion. In this manner, it is possible to minimize the number of winding layers which must be lifted by the yarn guide contour in order to prevent yarn from being wound around the yarn detaching device.

If during the initiation of the rewinding process the yarn guide contour extends down to the lowest winding layer of the spinning cake, it is assured that all winding layers of the spinning cake are positioned on the rewinding tube, and at the same time it is also assured that winding of yarn around the yarn detaching device is prevented.

In a further advantageous embodiment of the invention it is provided that the axial force component acting on the yarn detaching device during the initiation of the rewinding process is detected by a force transducer and is used to generate a signal. Thereafter the signal is further processed in the central control device of the pot spinning machine, or in a control device associated with the individual pot spinning stations, such that it is possible to make the assumption of a correct initiation of the rewinding process from the presence of such a signal. That is, when an appropriate signal is not received, it is immediately possible to start a fresh rewinding process.

The correct termination of the rewinding process is monitored, for example, in that the torque acting on the rewinding tube during the rewinding process is detected by a torque transducer. In this case, the signals from the torque transducer can be used in the control device for monitoring the correct running of the rewinding process on the basis of the known rewinding time.

The yarn detaching device in accordance with the invention preferably has a cutting edge, which can be placed against the conically wound portion of the spinning cake, and a yarn guide contour, which projects over the cutting edge in the axial direction. The yarn guide contour has an inclined yarn slide surface, by means of which the lower winding layers of the spinning cake are raised sufficiently that yarn cannot be wound around the yarn detaching device during the rewinding process.

As already indicated, the device in accordance with the invention has a force transducer in the area of the yarn detaching device, which detects the axial force component being generated during the rewinding process when the yarn runs up on the yarn slide surface, and transmits an appropriate signal to the control device via a signal line. This signal from the force transducer arranged on the yarn detaching device is interpreted as a successfully started rewinding process.

A torque transducer is preferably installed in the area of the rewinding tube holder, which detects the torque acting on the rewinding tube during the rewinding process. The torque transducer is also connected via a signal line to the control device so that, taking into consideration the known winding time, it is possible to monitor the progress of the rewinding process in a simple manner by means of the torque transducer.

In one embodiment, an adjustable yarn detaching element is arranged on the yarn detaching device to be movable from a rest position to a work position, which particularly offers the possibility of placing the yarn detaching element relatively gently against the lowest winding layers of the spinning cake. For example, in this way it is prevented that the yarn detaching element simultaneously grasps several of the winding layers of the spinning cake located on top of each other, which as a rule results in a spinning cop which later can not be unwound. With a too tight placement of the yarn detaching element there is the further danger that tilting moments are passed into the rotating spinning centrifuge, which could cause the magnetically seated spinning centrifuge to be displaced so that there is the danger of the centrifuge body contacting the centrifuge housing. Since such magnetically seated spinning centrifuges rotate at very high rpm, any mechanical contact of the centrifuge body with a stationary component of the pot spinning device is harmful and should therefore be prevented by all means.

In a preferred embodiment, the yarn detaching element is pivotably seated so that the yarn detaching element can be inserted without problems into the spinning centrifuge in an inwardly pivoted position and can subsequently be carefully placed against the lower yarn layers of the spinning cake deposited on the inner wall of the centrifuge by pivoting outwardly.

The yarn detaching element is preferably pivoted by means of a force, which gently and, if needed, elastically, i.e. resiliently, acts on the yarn detaching element. This elastic action on the yarn detaching element preferably takes place electrically or pneumatically. With a pneumatic device, the yarn detaching device has at least one positively controllable compressed air nozzle. By means of this compressed air nozzle, which is arranged behind the yarn detaching element, it is possible to act on a rear compressed air deflecting surface of the yarn detaching element, so that the yarn detaching element is pivoted out in the direction toward the spinning cake. The return of the yarn detaching element into its position of rest is provided either by a spring element or a second compressed air nozzle. With the arrangement of two compressed air nozzles, the yarn detaching element is either pivoted inwardly or outwardly, depending on which of the two compressed air nozzles is actuated. Control of the compressed air nozzles is provided here for example by means of dependable 2/2-way directional valves.

The device is preferably designed such that it is possible to definitively set the pneumatic pressure, and therefore the contact force, of the yarn detaching element on the spinning cake. Thus, a throttle device, for example, may be installed in the compressed air line leading to the compressed air nozzle which initiates the pivoting outwardly of the yarn detaching element.

The use of an electrically operated device is also possible in place of the above described pneumatic pivoting device. With such an electrically operated pivot device, a magnetic coil, which can be provided with a defined current supply, is for example arranged on the yarn detaching device. The yarn detaching element itself is made, at least partially, of a ferromagnetic material, so that the pivoting of the yarn detaching element into its working position is possible by an appropriate current supply to the magnetic coil, which is arranged as far as possible above or below the pivot shaft of the yarn detaching element.

By regulating the current strength, for example by means of a potentiometer, it is possible to adjust the force with which the yarn detaching element is placed against the spinning cake in a defined manner. Accordingly, the yarn detaching element can be gently pivoted inwardly, and the contact moment on the winding layers of the spinning cake can always be delicately limited.

Preferably not only the effective contact moment of the yarn detaching element against the spinning cake can be sensitively set, but the maximum displacement track of the yarn detaching element can also be preset. In this manner, the extreme working position of the cutting edge arranged on the yarn detaching element can be preset by means of an adjustable detent and can be corrected at any time, as needed.

In an advantageous embodiment, the yarn detaching element is arranged to be pivotable around a shaft inside a tubular yarn guide device having a yarn guide contour and a slit-like opening in its outer wall for passage therethrough of the yarn detaching element. This arrangement assures that the yarn detachment means is not accidentally covered with yarn during the rewinding operation, which would lead to an unusable spinning cop.

The rewinding process can be dependably and gently initiated by the defined placement of the cutting edge of the yarn detaching element against the lowest winding layer of the spinning cake. The cutting edge can have different shapes; for example, it can be embodied to be acutely angled, rectangular or the like.

Further details, features and advantages of the present invention will be described and understood from exemplary embodiments described below and represented in the accompanying drawings.

DETAILED DESCRIPTION OF THE PREFERRED EMBODIMENTS

Figure 1:
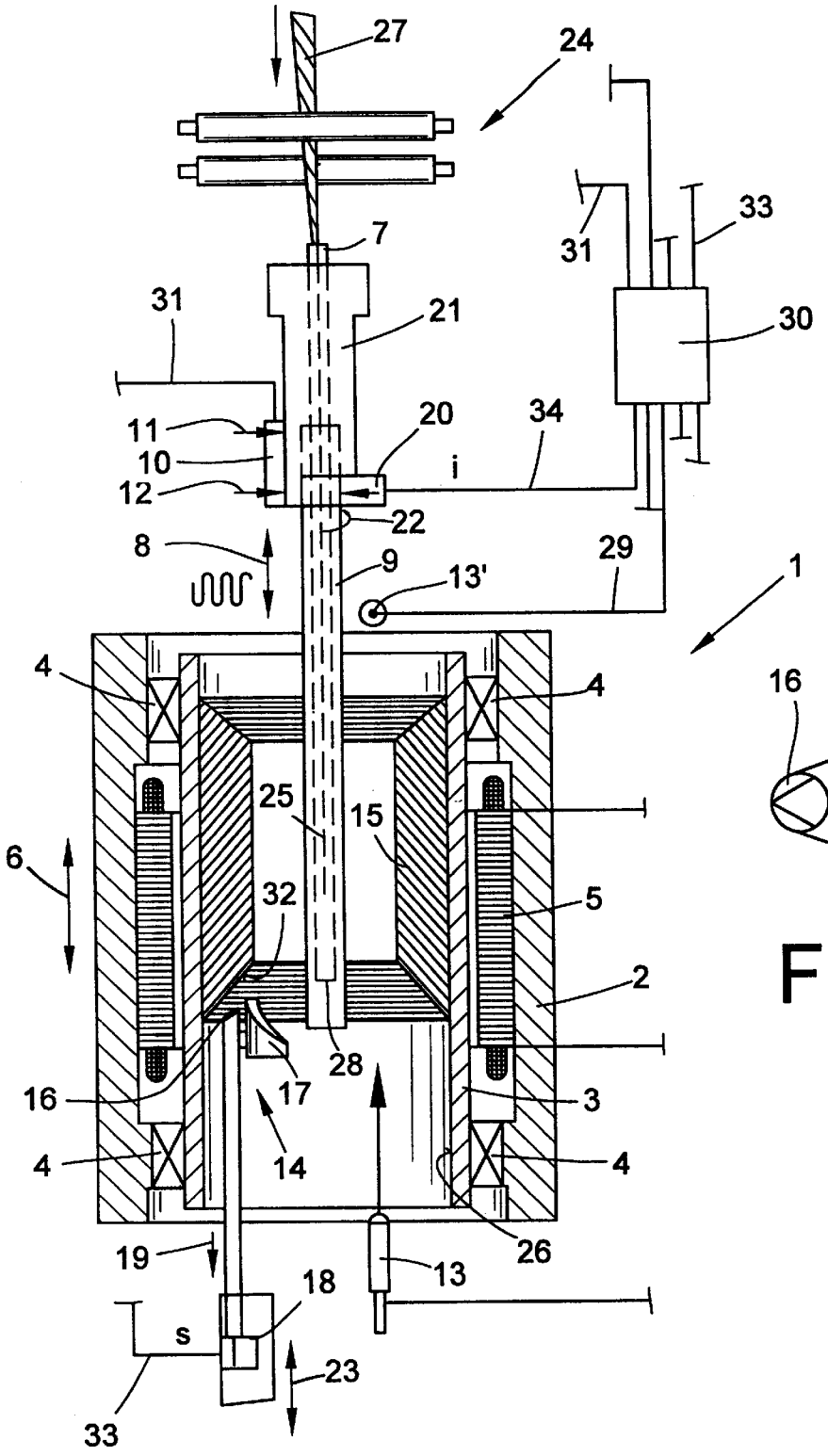
FIG. 1 is a schematic vertical cross-sectional view of a pot spinning device with a yarn detaching device for initiating the rewinding process, in particular following a yarn break, in accordance with the present invention.
Figure 2:
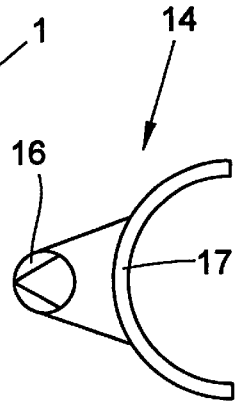
FIG. 2 is a top plan view of the yarn detaching device in FIG. 1.

Referring now to the accompanying drawings and initially to FIG. 1, a pot spinning device in accordance with the present invention is schematically represented and identified as a whole by reference numeral 1. Such pot spinning devices are known in principle and are relatively extensively described in existing publications, for example in German Patent Publication DE 196 37 270 A1.

Customarily such pot spinning devices have a spinning centrifuge 3 rotatably supported in a spinning housing 2 by bearings 4. Such spinning centrifuges are preferably driven by a single electric motor 5. As described in German Patent Publication DE 196 37 270 A1, the bearings are designed for example as permanent magnetic bearings.

The entire spinning housing 2 can also be displaced in the vertical direction by means of a drive 6, only schematically indicated in the drawing figures.

The pot spinning device 1 furthermore has a yarn guide tube 7, which can be introduced axially into the spinning centrifuge 3 and is reciprocably displaceable by means of a drive 8. A rewinding tube 9 is fixed in place in a rewinding tube holder 21 on the yarn guide tube 7. In this case the rewinding tube holder 21 has an arresting device 10 which fixes the rewinding tube in a resting position 11 during the normal spinning process and, as indicated in FIG. 1, during the rewinding process fixes the rewinding tube in a rewinding position 12.

In most cases such pot spinning devices 1 have a yarn break sensor, for example an opto-electronic sensor device. In the present exemplary embodiment the yarn break monitoring takes place by means of an opto-electronic sensor device 13, 13', which monitors the rotating yarn leg during the spinning process.

Furthermore, a yarn detaching device 14, which can be displaced by means of a drive 23 in parallel relation with the inner centrifuge wall 26, is provided for initiating the rewinding process after a yarn break. The yarn detaching device 14 has a cutting edge 16, which can be placed against the lower conically wound portion 32 of the spinning cake 15, as well as a yarn guide contour 17 extending along the cutting edge 16 in the axial direction.

In addition, the yarn detaching device 14 can be equipped with a force transducer 18 for detecting an axial force component 19. A comparable sensor device 20 can also be installed in the area of the rewinding tube holder 21. This sensor device 20, designed as a torque transducer, detects the torque 22 acting on the rewinding tube 9 during the rewinding process.

Figure 3:
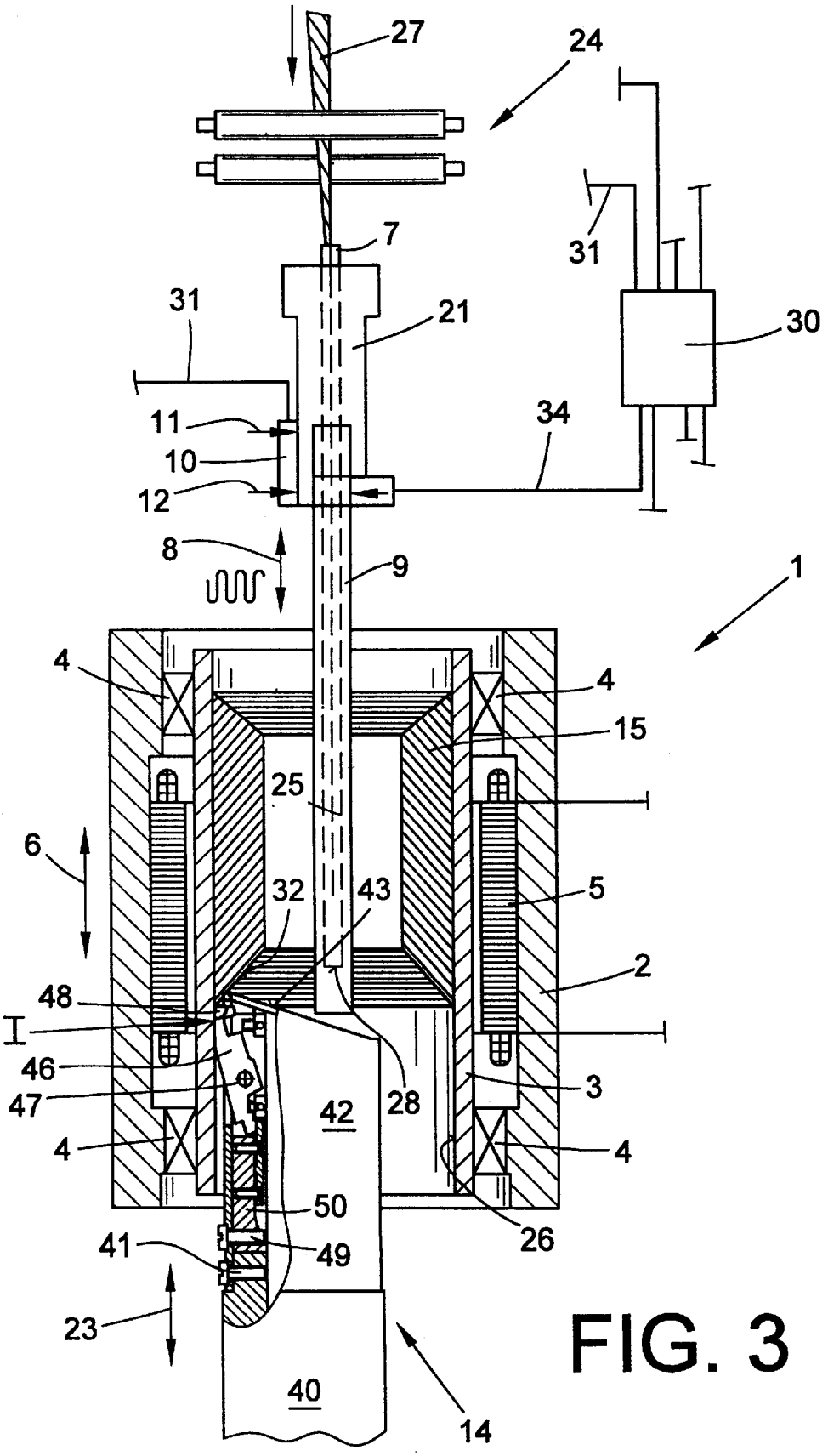
FIG. 3 is another schematic vertical cross-sectional view similar to FIG. 1 of a pot spinning device with a yarn detaching device in accordance with another embodiment of the present invention.
Figure 4:
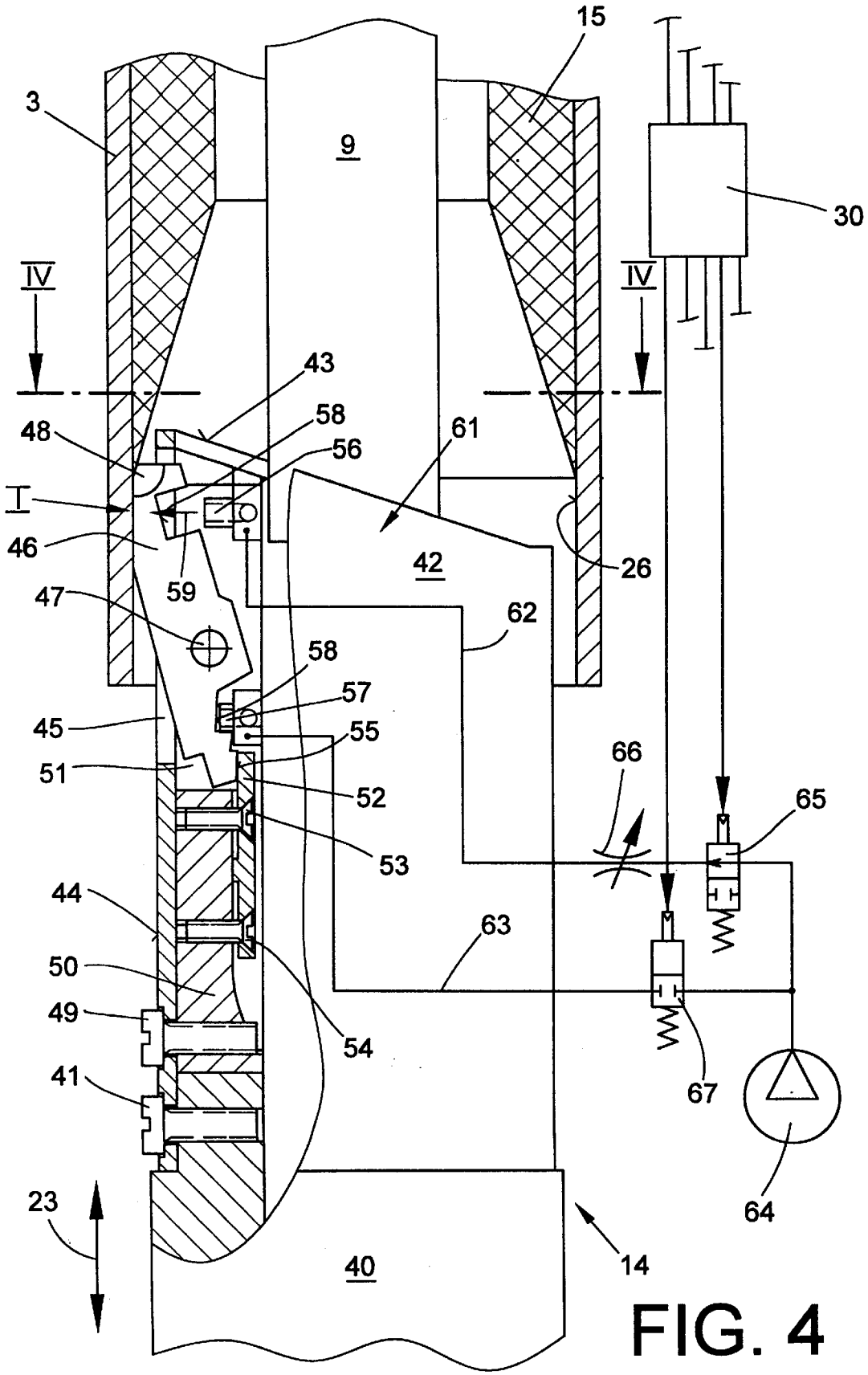
FIG. 4 is an enlarged cross-sectional view of the yarn detaching device in FIG. 3 in an embodiment having a pneumatically operating pivoting device, shown placing the yarn detaching element in its working position.
Figure 5:
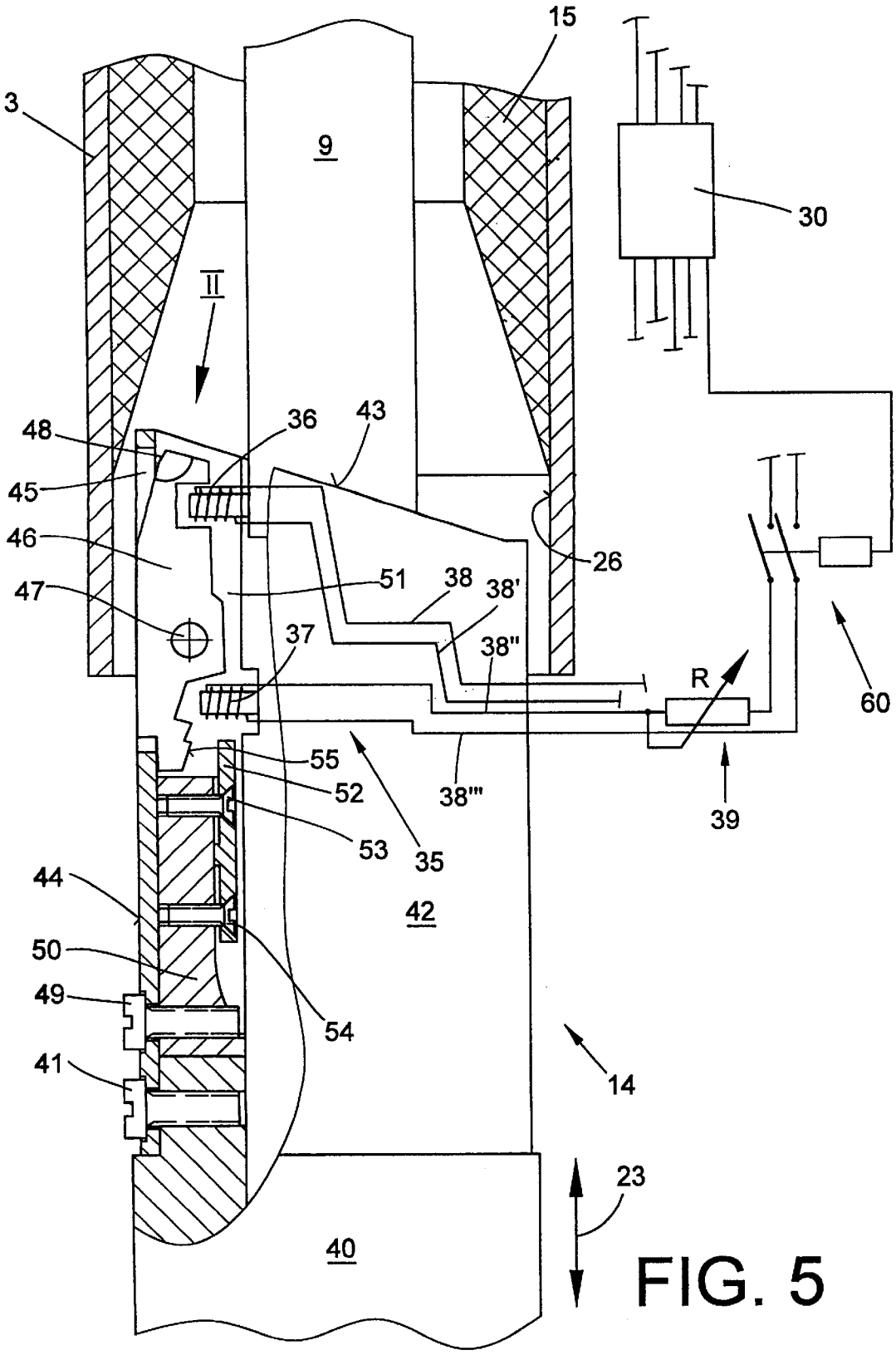
FIG. 5 is another enlarged cross-sectional view similar to FIG. 4, showing the yarn detaching device in FIG. 3 in an embodiment having an electrically operating pivoting device, shown placing the yarn detaching element in its position of rest.
Figure 6:
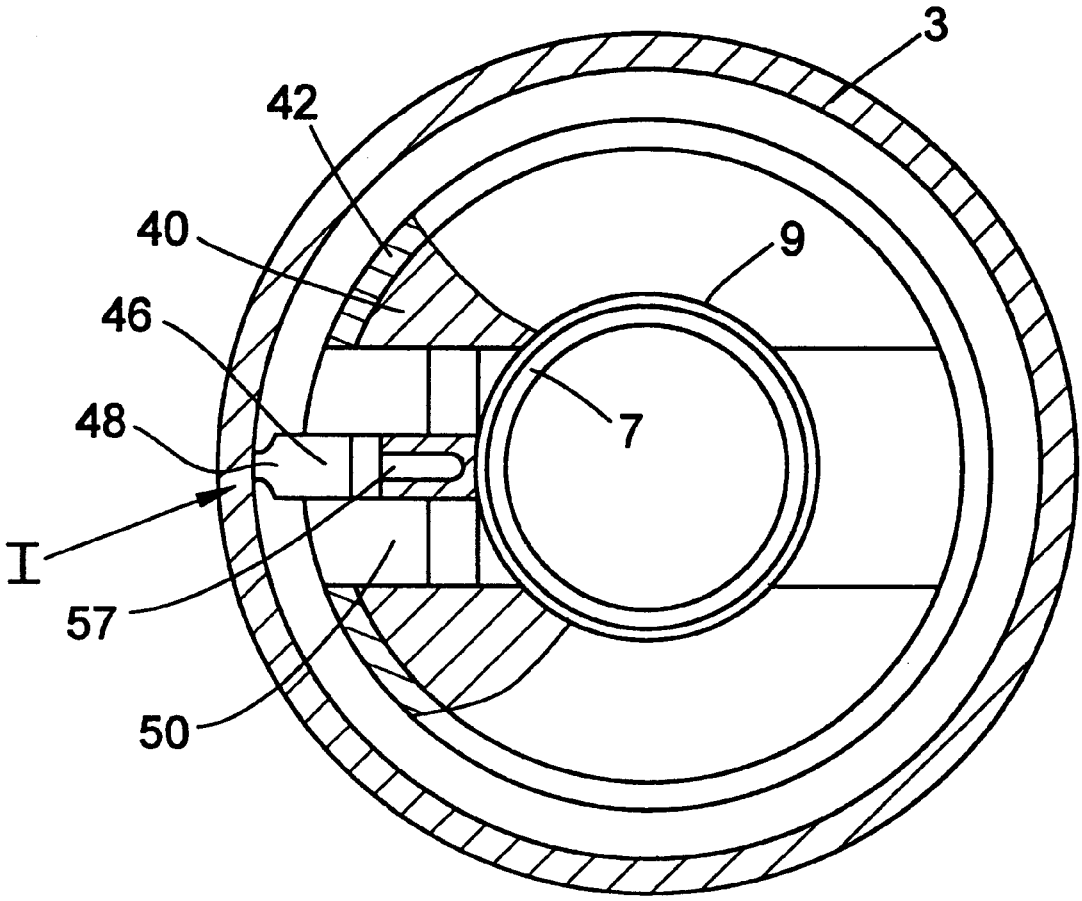
FIG. 6 is a top plan view of the yarn detaching device in accordance with the embodiment of FIG. 4 taken along section line VI—VI in FIG. 4.

In an advantageous embodiment, represented in FIG. 3, the yarn detaching device 14, which is represented on a larger scale in FIGS. 4, 5, and 6, has a base body 40, on which a tubular yarn guide device 42 is fixed in place by means of threaded bolts, or the like. At its leading end, this yarn guide device 42 has a yarn guide contour 43, and in the area of its outer cylindrical wall 44 has a slit-like opening 45 for a pivotably seated yarn detaching element 46.

A guide block 50, slit in the upper portion, is fixed in place on the tubular yarn guide device 42 from the inside by means of at least one threaded bolt 49. The pivotable yarn detaching element 46 is seated almost free of play in the guide slit 51 of the guide block 50 and is rotatable to a limited extend around a bolt 47. The pivotable yarn detaching element 46 has a cutting edge 48 on its upper end, which can have various cross-sectional shapes, preferably rectangular, as indicated in FIG. 6.

The maximum range of pivotal movement of the yarn detaching element 46 can be definitively set via a detent or stop surface 52, which is adjustable by means of threaded bolts 53, 54. The detent 52 is located in correspondence with, and for abutment by, a rear contact surface 55 of the yarn detaching element 46.

In a preferred embodiment, the yarn detaching element pivotably seated around a bolt 47 can be acted upon in an elastic or resilient manner, i.e., the yarn detaching element 46 can either be pivoted pneumatically, as indicated in FIG. 4, or electrically, as represented in FIG. 5.

In the exemplary embodiment represented in FIG. 4, the pneumatic pivoting device 61 comprises two compressed air nozzles 56, 57, which are connected with a vacuum source 64 via pneumatic lines 62, 63. In this case a 2/2-way directional valve 65, as well as a throttle device 66, are provided in the pneumatic line 62, while the pneumatic line 63 merely contains a 2/2-way directional valve.

In the exemplary embodiment represented in FIG. 5, the electrical pivoting device 35 comprises two electromagnetic coils 36, 37, which can be definitively provided with current from a current source (not represented) via current conductors 38, 38', 38", 38'". As shown by means of the example of the current conductors 38" and 38'", controllable electric contact switches 60 are connected into the current conductors.

Advantageously, at least the current conductor 38" has a potentiometer 39, which makes possible the defined setting of the current strength effective at the magnetic coil 37, and therefore the exact setting of the contact pressure of the yarn detaching element 46 against the lowest winding layer of the spinning cake 25.

The functional operation of the device may thus be understood with reference to FIGS. 3 to 5. A sliver drafting device arranged above the spinning centrifuge 3, for example a drafting arrangement 24, is supplied with a sliver from a spinning can (not represented) or, as indicated in FIG. 3, with a roving yarn 27 from a speed frame bobbin (also not represented).

A yarn 25 is created by the combined effect of the drafting device 24 and the rotating spinning centrifuge 3 as the drafted sliver or roving is delivered into the interior of the spinning centrifuge 3 via the yarn guide tube 7 and the yarn 25 is deposited as a spinning cake 15 on the inner wall 26 of the spinning centrifuge. During this yarn deposition, which in the present case starts in the upper area of the spinning centrifuge, the yarn guide tube 7 is reciprocated vertically by the drive 8. Simultaneously, the spinning housing 2 is continuously raised by the drive 6. As a result, the yarn is deposited in the form of a so-called cop winding on the inner centrifuge wall 26 of the spinning centrifuge 3, i.e. with tapered conically wound portions at the upper and lower ends of the centrifuge wall 26.

The rotating yarn leg exiting from the yarn guide mouth is continuously monitored during the formation of the spinning cake 15 by a sensor device, preferably the opto-electronic sensor device connected via a signal line with a control device 30 as represented in FIG. 1.

A yarn break is immediately detected by the sensor device because of the missing yarn leg and is reported to the control device 30, whereupon the control device 30 immediately activates a stubbing stop device in the area of the drafting arrangement 24, so that further delivery of roving 27 is interrupted. In addition, the control device 30 activates the arresting device 10 on the rewinding tube holder 21 via a signal line 34, which releases the rewinding tube 9 to slide from its rest position 11 into its rewinding position 12.

Thereafter the yarn detaching device 14 in accordance with the present invention is introduced upwardly into the spinning centrifuge 3 by means of its drive 23. The yarn detaching device 14, with the yarn detaching element 46 positioned in the rest position II, moves into the spinning centrifuge parallel with the inner centrifuge wall 26 and is positioned, for example, in the position represented in FIG. 5.

Thereupon, the yarn detaching element 46 is elastically pivoted out of the rest position II represented in FIG. 5 into the work position I indicated in FIGS. 3 and 4, and gently places its cutting edge 48 in contact with the lowest winding layer of the spinning cake 15, i.e. the yarn detaching element 46 is pivoted inwardly either by means of the pneumatically actuable pivoting device 61 or by means of the electrically operating pivoting device 35.

With the placement of the cutting edge 48 of the yarn detaching element 46 against the lowest winding layer, the latter is braked and the winding process is thereby initiated. In the course of this step, the lower winding layers, which are located relatively far downwardly along the lower conical portion of the yarn cake, are lifted by the yarn guide device 42, in particular by the yarn guide contour 43, sufficiently far that the winding of yarn around the yarn detaching device 14 is dependably prevented.

If the pneumatic pivoting device 61 with two compressed air nozzles 56, 57 is provided, the 2/2-way directional valve 65 is switched to an open position to permit airflow therethrough, as represented in FIG. 4, so that a stream 59 of compressed air exits from the compressed air nozzle 56. The pressure level of this stream of compressed air can be definitively set by means of the throttle device 66. The compressed air impacts on the deflecting surface 58 arranged on the back (i.e. the radially inwardly facing side) of the yarn detaching element 46, so that the yarn detaching element 46 is pivoted into the work position I represented in FIG. 4. In this work position I, the cutting edge 48 of the yarn detaching element 46 rests against the lowest winding layers of the spinning cake 15, and therefore initiates the previously described rewinding process.

The return of the yarn detaching element 46 into the rest position II takes place either by means of a second compressed air nozzle 57 or a spring element (not represented) acting upon the axially lower end of the yarn detaching element 46. With an arrangement of two compressed air nozzles, the directional valves 65, 67 are switched such that valve 65 is closed whereby no compressed air is delivered to the compressed air nozzle 56, while the valve 67 is opened to charge the compressed air nozzle 57 with compressed air.

When using the electrically operating pivoting device 35, the electric switch 60 placed into the current conductor 38" is closed by the control device 30, so that the electromagnetic coil 37 is provided with current. The yarn detaching element 46 is at least partially made of a ferromagnetic material, whereby the magnetic currents thereby created by the coil 37 charge, i.e. attract, the yarn detaching element 46 and pivot it into work position I indicated in FIGS. 3 and 5.

A potentiometer 39 in the current conductor 38" makes possible a defined setting of the effective magnetic force, so that a gentle contact between the cutting edge 48 of the yarn detaching element 46 and the spinning cake 15 can be assured.

The return of the yarn detaching element 46 into its position of rest II can also take place, as with the pneumatic pivoting device, either through a spring element (not represented), or by the appropriate supply of current to a second magnetic coil 36 acting upon the lower end of the yarn detaching element 46.

Other electrical drive variants in place of the above described magnetic coils are of course also conceivable, without departing from the general scope of the invention. For example, the pivoting of the yarn detaching element could also be performed by means of a bimetallic drive or the like.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a method of pot spinning wherein a yarn is deposited on the interior wall of a rotating spinning centrifuge in the form of a spinning cake having a conically wound portion at at least one end of the spinning cake, a method for initiating rewinding of the spinning cake onto a rewinding tube after a yarn break by introducing a yarn detaching device into the spinning centrifuge and applying the yarn detaching device to the spinning cake deposited on the interior wall of the centrifuge, the applying of the yarn detaching device to the spinning cake comprising providing a drive for the yarn detaching device, placing the yarn detaching device against the conically wound portion of the spinning cake using the drive, providing a yarn guide contour on the yarn detaching device, lifting the winding layers of the spinning cake to the level of the rewinding tube using the yarn guide contour, and preventing yarn from winding around the yarn detaching device during rewinding.

2. The method in accordance with claim 1, wherein the introducing step comprises introducing the yarn detaching device into the spinning centrifuge parallel with its interior wall, providing the conically wound portion of the spinning cake with an end area, and the applying step comprises contacting a cutting edge with the end area.

3. The method in accordance with claim 1, further comprising placing the yarn detaching device against the spinning cake with the yarn guide contour positioned in the area of the endmost winding layer of the spinning cake.

4. The method in accordance with claim 1, wherein the introducing step comprises axially moving the yarn detaching device providing a force transducer and controlling the axial movement by generating an axial force signal via the force transducer.

5. The method in accordance with claim 1, and further comprising providing a torque transducer detecting torque acting on the rewinding tube during the rewinding via the torque transducer and generating a torque signal.

6. In a device for pot spinning comprising a rotating spinning centrifuge having an interior wall, means for depositing a yarn thereon in the form of a spinning cake having a conically wound portion at at least one end of the spinning cake, and means for rewinding of the spinning cake onto a rewinding tube, a device for initiating rewinding of the spinning cake onto the rewinding tube after a yarn break comprising a yarn detaching device for introduction into the spinning centrifuge and application to the spinning cake deposited on the interior wall of the centrifuge, the yarn detaching device including a drive for placing the yarn detaching device against the conically wound portion of the spinning cake, a cutting edge for contacting the conically wound portion of the spinning cake, and a yarn guide contour for lifting winding layers of the spinning cake to the level of the rewinding tube and preventing winding of yarn around the yarn detaching device, the yarn guide contour being adapted for covering the cutting edge in an axial direction.

7. The device in accordance with claim 6, wherein the yarn detaching device further comprises a force transducer for detecting and transmitting to a control device a signal representing axial force applied by the yarn detaching device.

8. The device in accordance with claim 6, wherein the yarn detaching device further comprises a torque transducer arranged proximate a rewinding tube holder for detecting and transmitting to a control device a signal representing torque applied by the yarn detaching device.

9. The device in accordance with claim 6, wherein the means for depositing the yarn comprises a yarn guide tube operative for depositing the yarn against the interior wall of the spinning centrifuge in the form of cop winding.

10. The device in accordance with claim 6, wherein the yarn detaching device further comprises an adjustable yarn detaching element movable between a rest position and a work position.

11. The device in accordance with claim 10, wherein the yarn detaching element is pivotable on the yarn detaching device.

12. The device in accordance with claim 10, wherein the yarn detaching device comprises means for actuation of the yarn detaching element resiliently.

13. The device in accordance with claim 12, wherein the means for actuation of the yarn detaching element comprises electrical or pneumatic operating means.

14. The device in accordance with claim 13, wherein the means for actuation of the yarn detaching element comprises at least one controllable compressed air nozzle arranged on the yarn detaching device for selectively directing an air stream against an air deflecting surface on the yarn detaching element for actuating pivotal movement thereof.

15. The device in accordance with claim 13, wherein the means for actuation of the yarn detaching element comprises a device for selective energization by electric current for actuating pivotal movement of the yarn detaching element.

16. The device in accordance with claim 15, wherein the means for actuation of the yarn detaching element comprises at least one magnetic coil and the yarn detaching element is made at least partially of a ferromagnetic material for selective magnetic attraction or repulsion of the yarn detaching element in relation to energization of the at least one magnetic coil.

17. The device in accordance with claim 6, wherein the yarn detaching device comprises means for definitively setting a force with which the yarn detaching element is placed against the spinning cake.

18. The device in accordance with claim 6, wherein the yarn detaching device comprises a tubular yarn guide device having the yarn detaching element pivotably supported therein, the yarn guide contour being formed on the tubular yarn guide device and a slit-like opening being formed in the tubular yarn guide device for pivotal movement therethrough of the yarn detaching element.

19. The device in accordance with claim 6, wherein the yarn detaching device comprises a detent for definitively setting a work position of the yarn detaching element.

20. The device in accordance with claim 6, wherein the yarn detaching element has a cutting edge for placement against the lowest winding layer of the spinning cake.

21. The device in accordance with claim 20, wherein the cutting edge of the yarn detaching element is acutely angled or is rectangular.

* * * * *